US007708349B2

(12) United States Patent
Chen

(10) Patent No.: US 7,708,349 B2
(45) Date of Patent: May 4, 2010

(54) KNOCK DOWN CHAIR

(76) Inventor: Kate Chen, 1803 Regent Ct., Corinth, TX (US) 76210

( * ) Notice: Subject to any disclaimer, the term of this patent is extended or adjusted under 35 U.S.C. 154(b) by 0 days.

(21) Appl. No.: 12/114,476

(22) Filed: May 2, 2008

(65) Prior Publication Data

US 2008/0275718 A1 Nov. 6, 2008

Related U.S. Application Data

(60) Provisional application No. 60/916,094, filed on May 4, 2007.

(51) Int. Cl.
*A47C 1/124* (2006.01)
*A47C 3/04* (2006.01)
*A47C 7/16* (2006.01)
*A47C 7/00* (2006.01)

(52) U.S. Cl. ..... 297/448.1; 297/445.1; 297/449.1; 297/450.1; 297/451.1; 297/451.8; 297/440.1; 297/440.14; 297/440.15; 297/452.12; 297/452.63; 297/452.64; 297/239; 297/248

(58) Field of Classification Search ..... 297/448.1, 297/449.1, 450.1, 451.1, 451.8, 440.1, 440.14, 297/440.15, 248, 445.1, 452.12, 452.55, 297/452.63, 452.64, 239
See application file for complete search history.

(56) References Cited

U.S. PATENT DOCUMENTS

| | | | | | |
|---|---|---|---|---|---|
| 110,598 | A | * | 12/1870 | Smith | 297/451.1 |
| 2,453,090 | A | * | 11/1948 | Guild et al. | 297/448.1 |
| D161,177 | S | * | 12/1950 | Harrison | 297/451.1 X |
| 2,815,067 | A | * | 12/1957 | Richardson | 297/451.1 X |
| 2,835,317 | A | * | 5/1958 | Valtri | 297/451.1 X |
| 2,973,807 | A | * | 3/1961 | Close | 297/451.1 X |
| 2,981,319 | A | * | 4/1961 | Close | 297/451.1 |
| 3,000,669 | A | * | 9/1961 | Silverman | 297/451.1 |
| 3,057,661 | A | * | 10/1962 | Moxley | 297/451.1 |
| 3,159,428 | A | * | 12/1964 | Schier | 297/448.1 X |
| 3,203,731 | A | * | 8/1965 | Krueger | 297/239 |
| 3,365,233 | A | * | 1/1968 | Uyeda et al. | 297/239 |
| 3,402,963 | A | * | 9/1968 | Fujioka et al. | 297/248 |
| 3,567,284 | A | * | 3/1971 | Miller et al. | 297/451.1 |
| 3,708,202 | A | * | 1/1973 | Barecki et al. | 297/239 |
| 3,795,923 | A | * | 3/1974 | Thomas | 297/451.1 X |
| 3,797,885 | A | * | 3/1974 | Harman et al. | 297/445.1 |
| 3,856,352 | A | * | 12/1974 | Jacobi, Sr. | 297/423.15 |
| 4,400,031 | A | * | 8/1983 | DeDecker | 297/239 |
| 4,768,833 | A | * | 9/1988 | Virtue | 297/440.2 |
| 4,913,496 | A | * | 4/1990 | Oke | 297/448.1 X |
| 5,224,760 | A | * | 7/1993 | Gibbs | 297/448.1 |
| 5,282,669 | A | * | 2/1994 | Barile | 297/248 |
| 5,564,787 | A | * | 10/1996 | Barile | 297/445.1 X |
| 6,174,029 | B1 | * | 1/2001 | Swy | 297/448.1 |

(Continued)

FOREIGN PATENT DOCUMENTS

| | | | | | |
|---|---|---|---|---|---|
| DE | 3223321 | A1 | * | 3/1983 | 297/452.64 |

(Continued)

*Primary Examiner*—Rodney B White
(74) *Attorney, Agent, or Firm*—Howison & Arnott, L.L.P.

(57) ABSTRACT

An auditorium chair comprised essentially of four parts that interconnect creating a frame with a three point stability system. The auditorium chair structure has the following components: fastening with screws, snap tight buttons, or other fasteners, dimensioning in accordance with use in current auditorium chair sizes, and fabrication design enabling efficient shipment while maintaining stability and stacking capability.

17 Claims, 7 Drawing Sheets

U.S. PATENT DOCUMENTS

| | | | | |
|---|---|---|---|---|
| 6,523,904 | B1 * | 2/2003 | Vanderminden | 297/452.63 |
| 6,715,838 | B1 * | 4/2004 | Pflaster et al. | 297/448.1 X |
| 6,860,556 | B2 * | 3/2005 | Barile et al. | 297/448.1 X |
| 6,863,349 | B2 * | 3/2005 | Belic | 297/448.1 X |
| 7,017,990 | B2 * | 3/2006 | Mendenhall et al. | 297/248 |
| 2003/0090140 | A1 * | 5/2003 | Belic | 297/448.1 X |
| 2004/0217635 | A1 * | 11/2004 | Barile et al. | 297/448.1 X |
| 2005/0099052 | A1 * | 5/2005 | Bertolini et al. | 297/440.1 |
| 2009/0121534 | A1 * | 5/2009 | Brauning | 297/440.14 |

FOREIGN PATENT DOCUMENTS

| | | | | |
|---|---|---|---|---|
| DE | 3610225 | A1 * | 10/1987 | 297/248 |
| GB | 2072004 | A * | 9/1981 | 297/448.1 |

* cited by examiner

KNOCK DOWN CHAIR

CROSS-REFERENCE TO RELATED APPLICATIONS

This application claims the benefit of U.S. non-provisional application for patent Ser. No. 60/916,094, filed May 4, 2007, and entitled KNOCK DOWN CHAIR, the specification of which is incorporated herein by reference.

TECHNICAL FIELD

This invention is related to the field of general purpose, auditorium furniture; more specifically, to stackable and folding chairs for use in temporary and general seating for open areas.

BACKGROUND

A folding chair is a light portable chair that can be stored in a stack or row. They are usually used for parties, card games, and temporary seating. They typically can be stored quite easily by either a method of stacking one on top of the other or by folding them into a compact shape.

Folding chairs were already being used in ancient Egypt, Greece and Rome. The curule chair of the Roman magistrate was a folding chair, as well as the seat of the emperor. The frame was mostly made of wood, and seldom made of metal. The wood was inlaid with artistic carvings, gilded, and decorated with ivory. In Northern Europe, folding chairs date back to the Bronze Age.

The folding chair became especially widespread during the middle ages. Here it was treasured as a liturgical furniture piece. Since the 15th and 16th century the folding chair has mostly had arm and head rests. Newer chairs which are often found in functions and events are also called folding chairs. Today, the folding chair is mostly made of hard plastic or metal.

However, folding chairs can lack the stability of a stackable chair. Additionally, folding chairs pose a separate problem of requiring a storage rack to contain the chairs while the chairs are in the collapsed (folded) position for storage. Stackable chairs are not collapsed or folded for storage. Stackable chairs do not require a storage rack. Stackable chairs are readily stored by stacking one or more stackable chairs on top of another stackable chair.

In order to maintain the stability while stacked and maintain stability while an individual is seated on the stackable chair, the stackable chairs are typically assembled by welding the joints together at the manufacturer's location. After the manufacturer constructs a number of stackable chairs, the manufacturer ships the stackable chairs to a consumer or vendor as specified in an order by the consumer or vendor. Though the chairs can be stored readily by a stacking design, the stackable chairs are not shipped very easily. The object of the design and welded assembly at the manufacture is to facilitate more stability during storage by stacking one atop the other and maintaining a specified stability while an individual is seated on the stackable chair. As such, the stackable chairs are cumbersome to ship. What is needed is a stackable chair design that can be knocked-down to enable the manufacturer or vendor to maximize the number of chairs that can be shipped in one container while still maintaining the proper stability required for seating and the functionality of stacking.

SUMMARY

In one aspect thereof, there is disclosed a new auditorium chair structure. The auditorium chair structure has the following components: fastening with screws, snap tight buttons, or other fasteners, dimensioning in accordance with use in current auditorium chair sizes, and fabrication design enabling efficient shipment while maintaining stability and stacking capability.

The auditorium chair structure includes a knock-down design that provides the ability for the chair to be placed, while disassembled, in a more compact container for a more efficient shipping assisting in the reduction of shipping costs for the chair. The knock-down design further enables the purchaser of the chair to easily and quickly assemble the chair. Additionally, the knock-down design is such that, once assembled, the chair is readily stackable with other chairs of the same or similar design.

The auditorium chair structure is further designed to be interlocked with other chairs of the same or similar design. Each auditorium chair structure has an interlocking connection on each side of the chair to create a more stable, and readily detachable, interlocking connection with an adjoining chair of the same or similar design.

BRIEF DESCRIPTION OF THE DRAWINGS

For a more complete understanding, reference is now made to the following description taken in conjunction with the accompanying Drawings in which.

Figure 1:
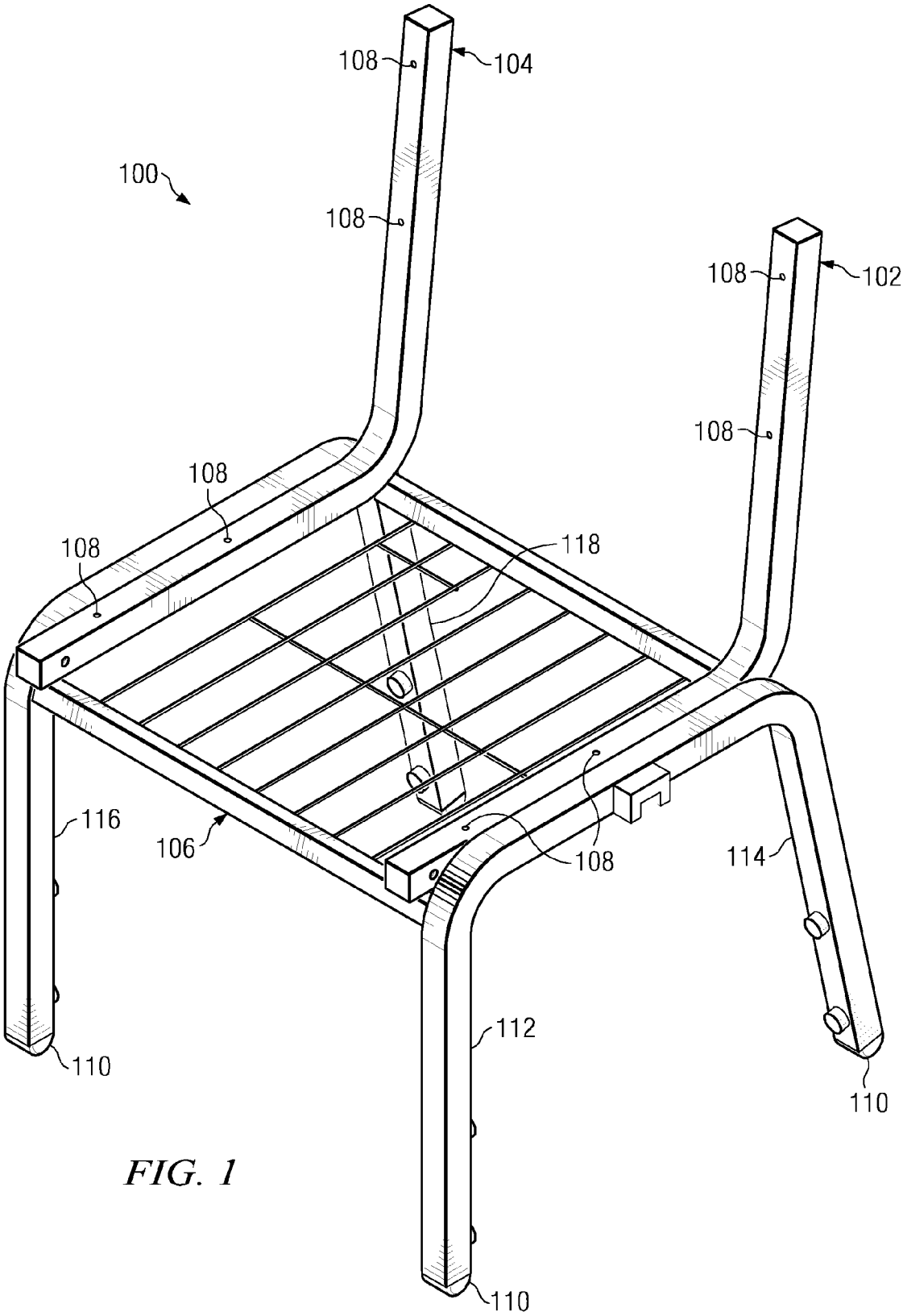
FIG. 1 illustrates an exemplary embodiment of a knock-down chair.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Referring now to the drawings, wherein like reference numbers are used herein to designate like elements throughout, the various views and embodiments of a knock down chair are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The present invention comprises of an apparatus for stackable, temporary, knock-down auditorium seating.

An exemplary apparatus for stackable, temporary, auditorium seating is disclosed. The apparatus includes a support frame and cross-members. The apparatus is dimensioned to conform with and for use with current auditorium seating dimensions. The apparatus further includes a connection joint to enable interlocking with additional auditorium seats.

A method for shipping and assembling a stackable chair is disclosed. The method includes providing a stackable chair that includes a support frame and cross-members. The stackable is dimensioned to conform to and for use with current auditorium seating dimensions. The method includes placing the stackable chair in a disassembled arrangement into a container for shipping and providing a knock-down design that enables and end use to quickly and readily assemble the stackable chair.

Referring now to FIG. 1, an exemplary embodiment of the knock-down auditorium (hereinafter "knock-down") chair 100 is shown. The knock-down chair 100 has a right frame member 102 and a left frame member 104. The knock-down chair 100 additionally has a cross-member 106 forming a substantially planar lower support layer. The right frame member 102 and left frame member 104 have holes 108 through the right and left frame members 102, 104 to enable fastening of a backrest and seat (not shown). The backrest and seat may be constructed of a rigid material or a fabric. The back and seat may further comprise a cushion affixed thereto. The back and seat may be secured to the knock-down chair 100 by a series of screws fastened via the holes 108 into the back and seat. Optionally, the back and seat can be detachably connected to the knock-down chair 100 via another fastening means including, but not limited to, a series of push pin-type connections, snap tight buttons, or other fasteners establishing a secure connection between the back and the knock-down chair 100 and the seat and the knock-down chair 100. The right frame member 102, left frame member 104, and cross-member 106 may all be fabricated of wood, metal, plastic or other materials and composite materials as known in the art with sufficient rigidity and stability for use in an auditorium chair. Such composite materials include, but are not limited to, Fiber reinforced polymers (FRPs), carbon-fiber reinforced plastic (CFRP), glass reinforced plastic (GRP), thermoplastic composites, short fiber thermoplastics, long fiber thermoplastics, long fiber reinforced thermoplastics, thermoset composites, metal matrix composites (MMC), ceramic matrix composites including bone (hydroxyapatite reinforced with collagen fibers), Cermet (ceramic and metal), and engineered wood including plywood, oriented strand board, wood plastic composite (recycled wood fiber in polyethylene matrix), Pykrete (sawdust in ice matrix), Plastic-impregnated or laminated paper or textiles, Arborite, Formica (plastic), and Micarta.

Glides 110 are attached to a bottom end of a front leg 112 and a bottom end of a rear leg 114 of the right frame member 102. Glides 110 are also attached to a bottom end of a front leg 116 and a bottom end of a rear leg 118 of the left frame member 104. The glides 110 are adapted to provide a non-abrasive contact between the legs of the knock-down chair 100 and a floor surface. The glides 110 may be rubber, wood, or metal. Further, the glides may be pivotally attached to the legs 112, 114, 116, 118 to facilitate a more comprehensive connection with an uneven floor surface. Skilled artisans will appreciate that casters can be used in place of the glides 110.

Figure 2:
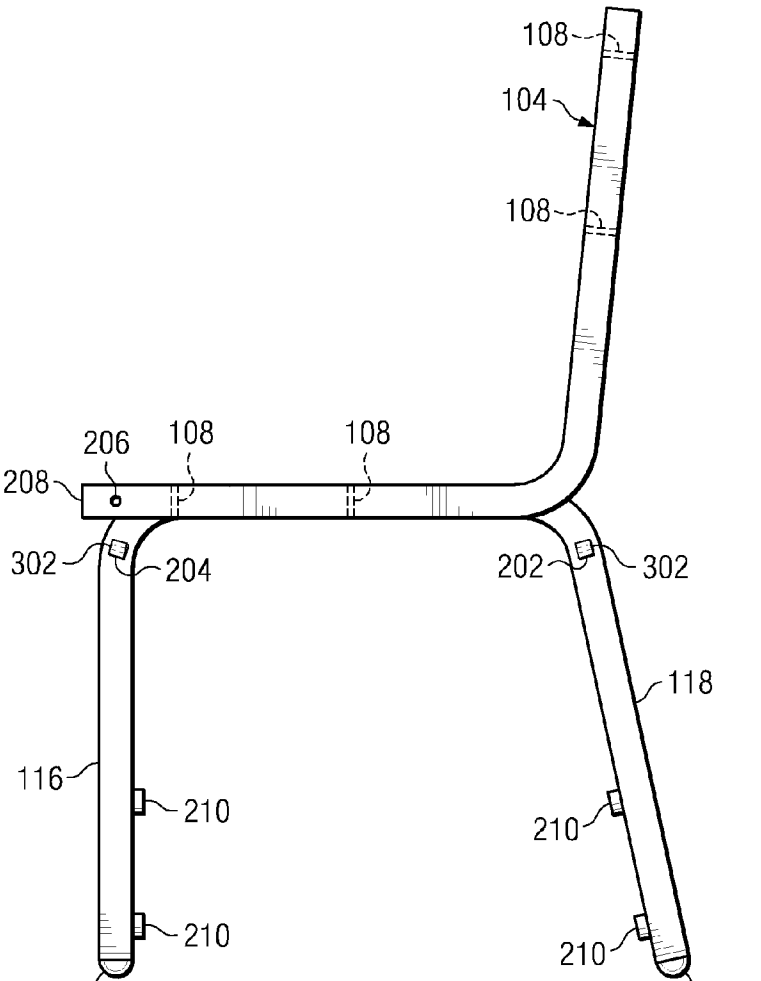
FIG. 2 illustrates a profile view of an exemplary left frame support structure of a knock-down chair.

Referring now to FIG. 2, an exemplary left frame member 104 is shown. The left frame member 104 has a rear male joint 202 welded onto the interior side of the rear leg 118. The left frame member additionally has a front male joint 204 welded onto the interior side of the front leg 116. The rear male joint 202 and front male joint 204 can be dimensioned to be rectangular in shape. The rear male joint 202 is dimensioned to be approximately ⅝ inch by ⅝ inch square and extends approximately one inch from the interior side of the rear leg 118 of the left frame member 104. The front male joint 204 is also dimensioned to be approximately ⅝ inch by ⅝ inch square and extends approximately one inch from the interior side of the front leg 116 of the left frame member 104. Artisans of skill will appreciate that these dimensions are exemplary and that many other dimensions can be utilized. Furthermore, the front male joint 204 and the rear male joint 202 can be dimensioned to be circular, oval shaped, triangular, pentagon shaped, or uniquely dimensioned such that it does not conform to a readily identifiable shape and may be uniquely associated to the knock-down chair 100.

Figure 3B:
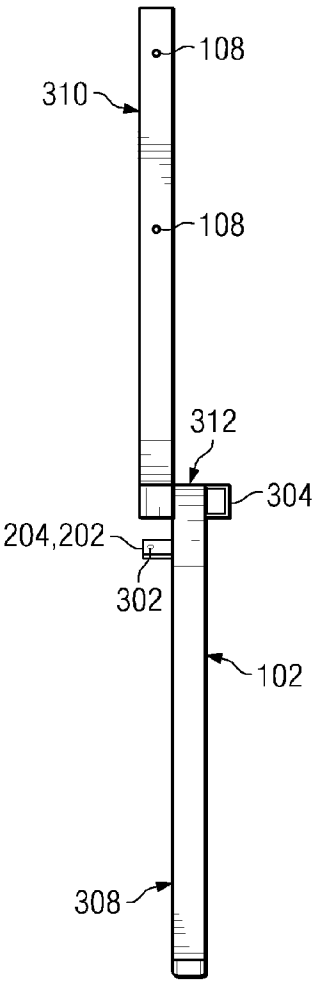
FIGS. 3A, 3B and 3C illustrate views of exemplary support structures of a knock-down chair.
Figure 3A:
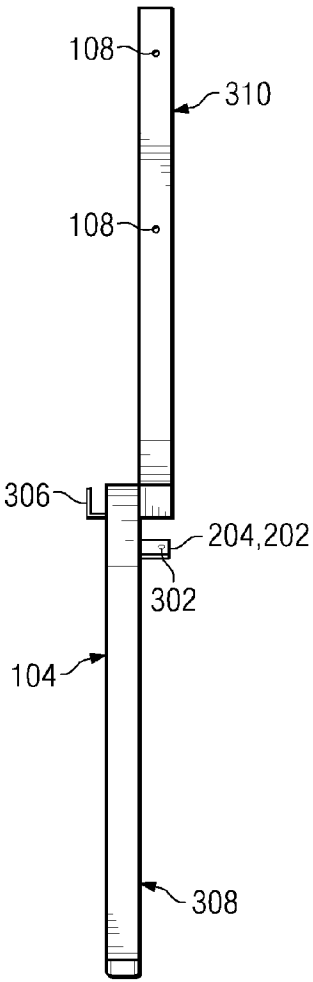
Figure 3C:
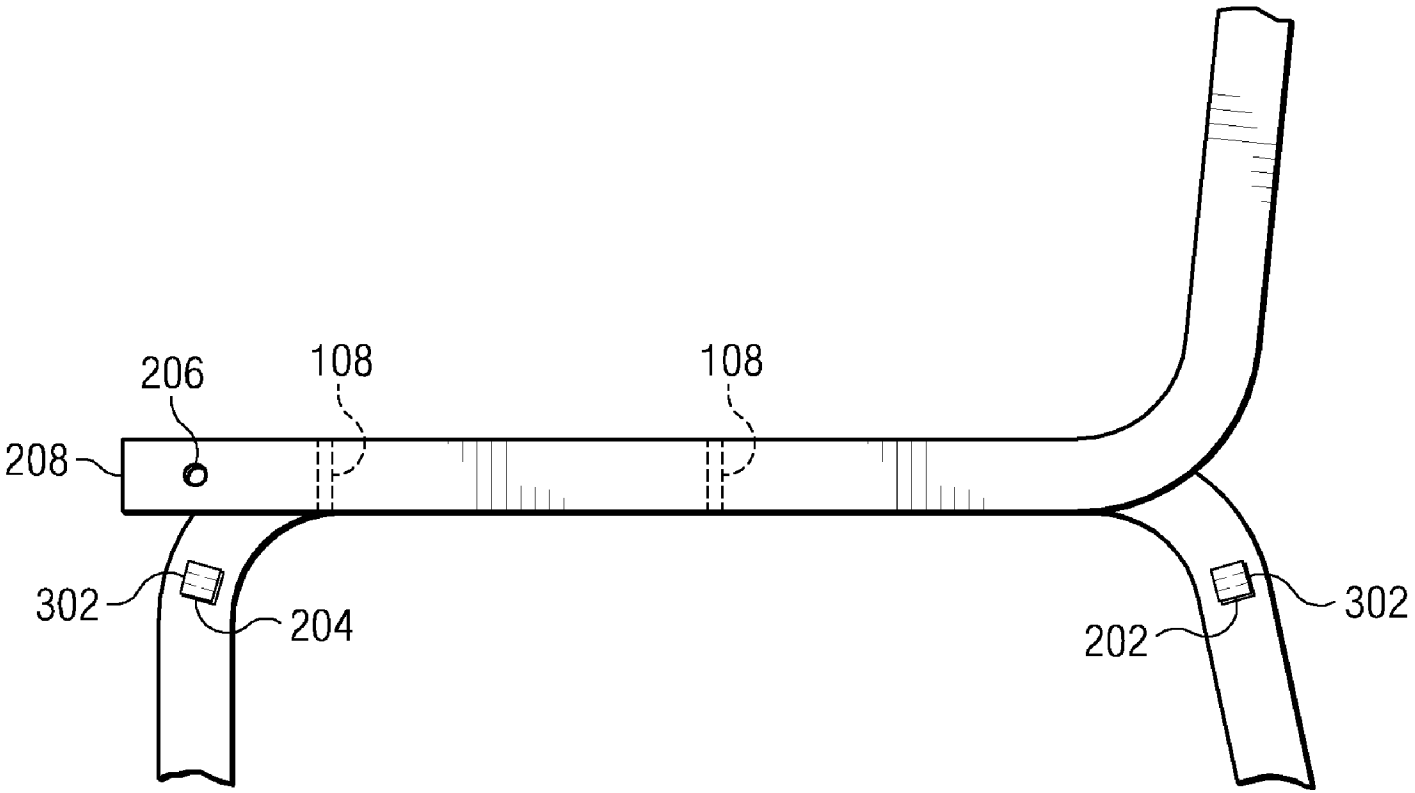

Additionally, as depicted in FIGS. 3A and 3C, a threaded channel 302 extends through the rear and front male joints 202, 204. The threaded channel 302 extends from a front facing side of the rear male joint 202 to a rear facing side of the rear male joint 202. The threaded channel 302 extends on a path substantially parallel to the interior side of the rear leg 118 of the left frame member 104. The threaded channel 302 extends on the substantially parallel path to the interior side of the rear leg 118 at approximately ¾ inch distance from the interior side the rear leg 118. Artisans of skill will appreciate that this distance is exemplary and many other distances are possible. Additionally, some embodiments provide for more than one threaded channel 302 extending on a path substantially parallel to the interior side of the rear leg 118 of the left frame member 104. Furthermore, the rear male joint 202 is welded to the interior side of the rear leg 118 such that the rear facing side of the rear male joint 202 is substantially parallel to the rear facing surface of the rear leg 118 of the left frame member 104.

Additionally, a threaded channel 302 extends from a front side of front male joint 204 to a rear side of the front male joint 204. The threaded channel 302 extends on a path substantially parallel to the interior side of the front leg 116 of the left frame member 104. The threaded channel 302 extends on a path substantially parallel to the interior side of the front leg 116 of the left frame member 104 at approximately ¾ inch distance from the interior side of the front leg 116. Artisans of skill will appreciate that this distance is exemplary and many other distances are possible. Additionally, some embodiments provide for more than one threaded channel 302 extending on a path substantially parallel to the interior side of the front leg 116 of the left frame member 104. Furthermore, the front male joint 204 is welded to the interior side of the front leg 116 such that the front facing side of the front male joint 202 is substantially parallel to the front facing surface of the front leg 116 of the left frame member 104. Artisans of ordinary skill can appreciate that these measurements comprise one example. Other dimensions and shapes can be utilized to accomplish the same functionality.

As shown in FIGS. 3B and 3C, a rear and front male joint 202, 204 are each welded to the interior side of the right frame member 102. The rear male joint 202 is similar the front male joint 204 in composition, dimensioning, and shape. A threaded channel 302 extends through the rear and front male joints 202, 204 of the right frame member 102. The threaded channel 302 extends from a front facing side of the rear male joint 202 to a rear facing side of the rear male joint 202. The threaded channel 302 extends on a path substantially parallel to the interior side of the rear leg 114 of the right frame member 102. The threaded channel 302 extends on a path substantially parallel to the interior side of the rear leg 114 of the right frame member 102 at approximately ¾ inch distance from the interior side of the rear leg 114 of the right frame member 102. Artisans of skill will appreciate that this distance is exemplary and many other distances are possible. Additionally, some embodiments provide for more than one threaded channel 302 extending on a path substantially parallel to the interior side of the rear leg 114 of the right frame member 102. Furthermore, the rear male joint 202 is welded to the interior side of the rear leg 114 of the right frame member 102 such that the rear facing side of the rear male joint 202 is substantially parallel to the rear facing surface of the rear leg 114 of the right frame member 102.

Additionally, a threaded channel 302 extends from a front facing side of front male joint 204 to a rear facing side of the front male joint 204. The threaded channel 302 extends on a path substantially parallel to the interior side of the front leg 112 of the right frame member 102 at approximately ¾ inch distance from the interior side of the right frame member 102. Artisans of skill will appreciate that this distance is exemplary and many other distances are possible. Additionally, some embodiments provide for more than one threaded channel 302 extending on a path substantially parallel to the interior side of the front leg 112 of the right frame member 102. Furthermore, the front male joint 204 is welded to the interior side of the front leg 112 of the right frame member 102 such that the front facing side of the front male joint 202 is substantially parallel to the front facing surface of the front leg 112 of the right frame member 104. Artisans of ordinary skill can appreciate that these measurements comprise one example. Other dimensions and shapes can be utilized to accomplish the same functionality. For example, instead of utilizing rectangular tubes, circular tubes may be utilized as well as different diameters and inch measurements. Furthermore, solid beams or hollow tubes may be used.

Referring back to FIG. 2, a frame leg support brace channel 206 extends through the left frame support 104. This frame leg support brace channel 206 extends along a path substantially perpendicular to the interior side of the left frame support 104. This frame leg support brace channel 206 extends along a path substantially perpendicular to the interior side of the left frame support 104 at approximately 1½ inches from the front edge 208 of the left frame support 104. A similar channel 206 extends through the right frame support 102 (not shown). Artisans of skill will appreciate that this distance is exemplary and many other distances are possible.

Attached on the rear facing surface of the front leg 116 and the front facing surface of the rear leg 118 are stacking bumpers 210. The stacking bumpers 210 can be made from a plurality of materials including rubber, wood, plastic and metal. The stacking bumpers 210 can be in a plurality of colors and dimensioned to be square, rectangular, circular, triangular, or oval shaped, or dimensioned to be a shape not readily identifiable that may be unique to the knock-down chair 110. The stacking bumpers 210 are configured to provide a substantially non-abrasive barrier between knock-down chairs 100 when in the stacked position. Further, the stacking bumpers 210 can be configured with a coefficient of friction sufficient to assist in the stability of a plurality of knock-down chairs 100 in the stacked position by assisting in the reduction of lateral slipping between the stacked knock-down chairs 100.

Referring now to FIGS. 3A and 3B, there is illustrated the right frame member 102 and left frame member 104. As can be seen, the right frame member 102 is substantially similar to the left frame member 104. The right frame member 102 and left frame member 104 are comprised of two sets of rectangular tubes. Each set of rectangular tubes is further comprised of one rectangular tube for the lower half 308 and a rectangular tube for the upper half 310. The rectangular tube for the lower half 308 is molded into an inverted "U" shape to form the front legs 112, 116 and rear legs 114, 118 (see FIG. 2). The rectangular tube for the upper half 310 is molded into an "L" shape to form the seat and back (see FIG. 2). The lower half 308 is welded to the upper half 310 at the crest of the inverted "U" of the lower half 308 to the lower leg of the "L" of the upper half 310. A planar seat layer 312 is created at the weld between the lower half 308 and upper half 310. A seat (not shown) can be removably attached to the planar seat layer 312 by screws, snap tight buttons, or other fasteners.

Some embodiments of the knock-down chair include the use of circular tubes, or oval tubes in place of rectangular tubes. In such embodiments, the points where one tube contacts a second tube may be secured by additional welding to assist in maintaining stability. Additional embodiments provide that multiple sheets of metal are welded together to form the rectangular tubes described herein. In such embodiments, the sheets of metal that would exist between the connection of the lower half 308 connect to the upper half 310 may be omitted such that a hollow channel is created within the connection of the lower half 308 and the upper half 310. In some embodiments, each side 102, 104 of the knock-down chair are fabricated whole. In such embodiments, the sides 102, 104 may be cast into a shape that conforms with the stackable design (as illustrated in FIGS. 2, 3A and 3B). In some embodiments, the sides 102, 104 may be manufactured through an injection molding process or a milling process.

Attached to the frames 102, 104 of the chair is an interlocking interface. The interlocking interface is a knock-down fitting which comprises a pair of interlockable elements adapted to be secured to respective sides of the knock-down chair for maintaining said sides in fixed relation to one another when the elements are interlocked. The elements have co-operable means inter-engageable in a snap-fitting manner to secure the elements together substantially without play.

An interlocking receiver joint 304 is welded to the exterior side of the right frame member 102. The interlocking receiver joint 304 is comprised of a sheet of metal dimensioned to be approximately 2½ inches long by 1¾ inches wide by ⅛ inches thick. An opening 314 (illustrated in FIG. 5 as part of the final form of the interlocking receiver joint 304) is cut into the sheet. The first edge of the opening is approximately ⅝ inches from a first edge of the sheet of metal. The second edge of the opening is approximately 1⅛ inches from the trailing edge of the sheet of metal. The opening is dimensioned to be ⅞ inches wide. The opening 314 centered across the width of the metal sheet. The sheet is bent at ninety degrees at approximately one inch from the first edge of the sheet of metal. The sheet is bent at ninety degrees in the same direction as the first bend at 2 inches from the first edge of the sheet of metal. As a result of the two ninety degree bends, the interlocking receiver joint 304 is formed with a lower segment, a side segment and an upper segment. Additionally, as a result of the two ninety degree bends, the opening 314 is disposed along the lower and side segments of the interlocking receiver joint 304. The interlocking receiver joint 304 is welded to the exterior side of the right frame member 102 along the lower segment of the interlocking receiver joint 304. The weld joint between the right frame member 102 and the lower segment of the metal sheet forming the interlocking receiver joint 304 extends from the first edge of the metal sheet to the first edge of the opening of the interlocking receiver joint 304 such that the opening 314 extends substantially from the right frame member 102 (as illustrated in FIG. 5). The interlocking receiver joint 304 is additionally welded to the right frame member 102 at the second edge of the metal sheet forming interlocking receiver joint 304. The interlocking receiver joint 304 is welded to the exterior side of the right frame member 102 such that the side segment of the interlocking receiver joint 304 is substantially parallel to the exterior side of the right frame member 102. The interlocking receiver joint 304 is welded to the exterior side of the right frame member 102 such that the interlocking receiver joint 304 is placed approximately eight inches from the front facing surface of the front leg 112. Artisans of skill will appreciate that these dimensions are exemplary and many other dimensions are possible.

An interlocking hook joint 306 is welded to the exterior side of the left frame member 104. The interlocking hook joint 306 is comprised of a second metal sheet dimensioned approximately 2⅛ inches long, ⅝ inches wide and ⅛ inches thick. The sheet is bent at ninety degrees at approximately 1⅜ inch from the first edge of the second sheet of metal. As a result of the ninety degree bend, the second metal sheet is formed with a lower segment and a side segment. The second metal sheet is welded to the exterior side of the left frame member 104 along the lower segment of the second metal sheet. The weld joint between the left frame member 104 and the lower segment of the metal sheet extends from the first edge of the metal sheet to a point approximately ⅞ inches from the first edge. The second metal sheet is welded to the exterior side of the left frame member 104 such that the side segment of the second metal sheet is substantially parallel to the exterior side of the left frame member 104. The metal sheet is welded to the exterior side of the right frame member 102 such that the interlocking hook joint 306 is placed approximately 8½ inches from the front edge of the front leg 116. The interlocking hook joint 306 is compatible for coupling with an interlocking receiver joint 304 of another knock-down chair 100.

In some embodiments, different interlocking means are employed. In such embodiments, the interlocking means can include, but are not limited to, magnetically coupled connectors, hook and loop connectors, fabric connectors affixed to the sides 102, 104 via rivets or other fastening means, push-pin male and female connectors, snap-type connectors, and sliding male/female connectors. The interlocking means (connectors) can be attached by various means as is known in the art. Furthermore, the interlocking means are configured such that similar knock-down chairs are adapted to connect to other similar knock-down chairs with a compatible connector. In such embodiments, the knock-down chair 100 includes an interlocking means on the exterior of each side 102, 104 of the knock-down chair 100. If the interlocking connection means requires that one connector be a male type connector and the other be a female type connector, then the male connectors will all be installed on a first side of the knock-down chair 100 and the female connectors installed on the second side of the knock-down chair 100. For example, each knock-down chair 100 can have the male type connector of the interlocking means installed on the exterior of the right frame member 102 and the female connector of the interlocking means installed on the exterior of the left frame member 104. As such, when two knock-down chairs 100 are placed next to each other with the fronts of the knock-down chairs 100 facing the same direction, the male connection interlocking means on the first knock-down chair 100 will align and interlock with the female connection interlocking means on the second knock-down chair 100.

Figure 4A:
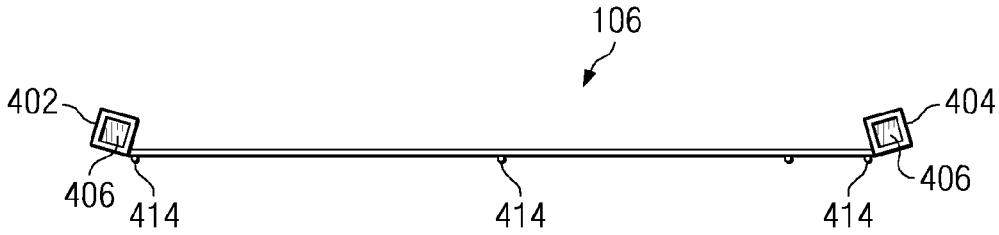
FIGS. 4A and 4B illustrate plan and profile views of an exemplary cross-member of a knock-down chair.
Figure 4B:
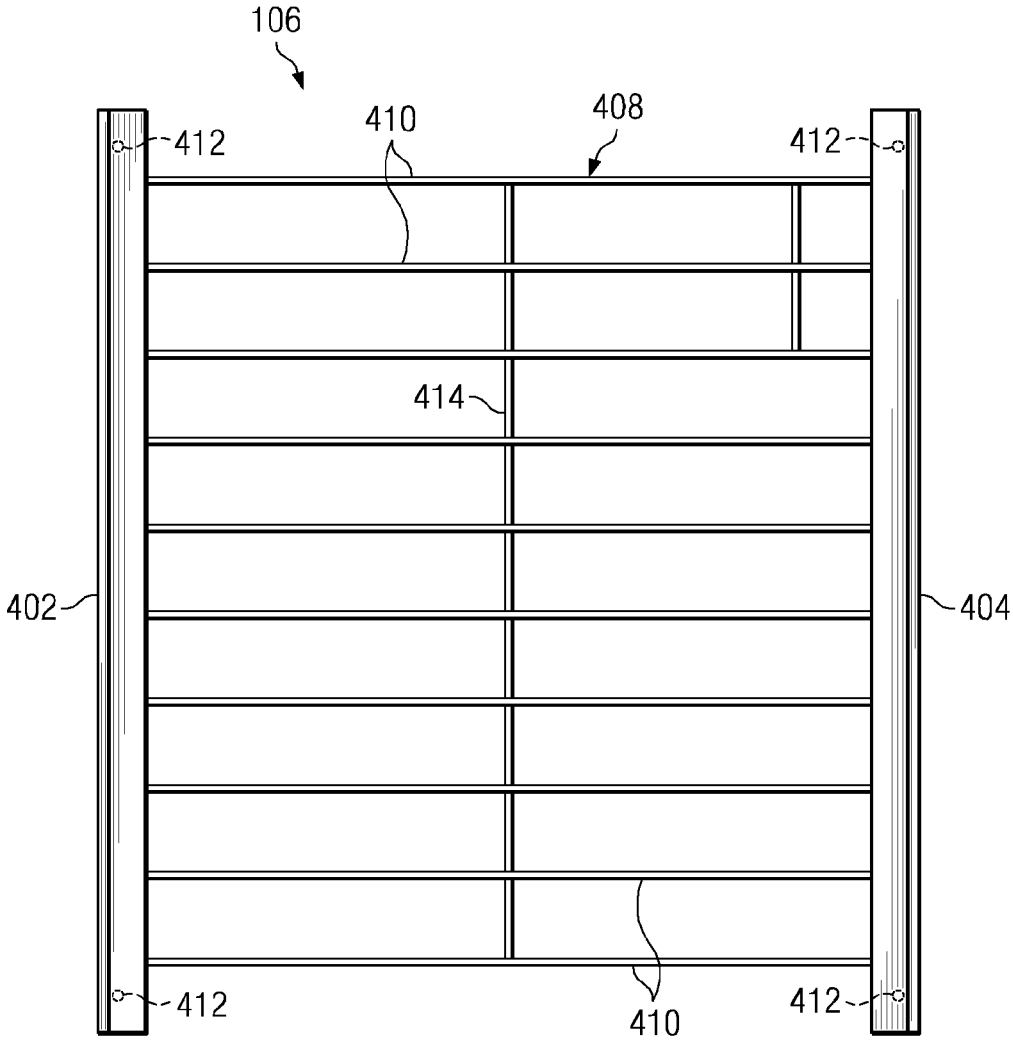

Referring now to FIGS. 4A and 4B, there is depicted profile and plan views of an exemplary cross-member 106 for a knock down chair. The cross-member 106 has a front support member 402 and a rear support member 404. The front support member 402 and the rear support member 404 are each rectangular tubes dimensioned to be approximately ¾ inch by ¾ inch and approximately 18¼ inches long. Artisans of skill will appreciate that many other shapes and configurations are possible as described herein with respect to the rectangular tubes of the right and left frames 102, 104. The front support member 402 and the rear support member 404 are set substantially parallel to each other. The front support member 402 has a rectangular channel 406 disposed to fit over and around the front male joints 202 of the right and left frame members 102, 104. The rear support member 404 has a rectangular channel 406 disposed to fit over and around the rear male joints 204 of the right and left frame members 102, 104. Additionally, in such embodiments where the front and rear male joints 202, 204 are dimensioned to be a different shape, or a unique shape, the channels 406 are similarly dimensioned to be disposed to fit over and around the front and rear male joints 202, 204 of the right and left frame members 102, 104.

Additionally, there is a wire mesh 408 comprised of long rods 410 that are dimensioned to be approximately ⅛ inch in diameter. The long rods 410 are set substantially parallel to each other. Three cross rods 414 are welded to the long rods 410 to create the wire mesh 408. The cross rods 414 are dimensioned to be approximately ⅛ inch in diameter. The wire mesh 408 is welded to a lower edge of the front support beam 402 and to a lower edge the rear support beam 404. The wire mesh 408 is welded such that the long rods 410 are substantially perpendicular to the front support member 402 and the rear support member 404. The wire mesh 408 may also be constructed of various materials including, but not limited to, wood, metal, or plastic.

A threaded hole 412 is set approximately ¾ inch from each end of the front support member 402. The threaded hole 412 is placed on the lower edge of the front support member 402. Another threaded hole 412 is set approximately ¾ inch from each end of the rear support member 404. The threaded hole 412 is placed on the lower edge of the rear support member 404. The threaded hole 412 is positioned such that when the channel 406 of the front support member 402 and the channel 406 of the rear support member 404 are joined over and around the rear and front male joints 202, 204, the threaded hole 412 aligns with the threaded channel 302 of the rear and front male joints 202, 204.

Figure 5A:
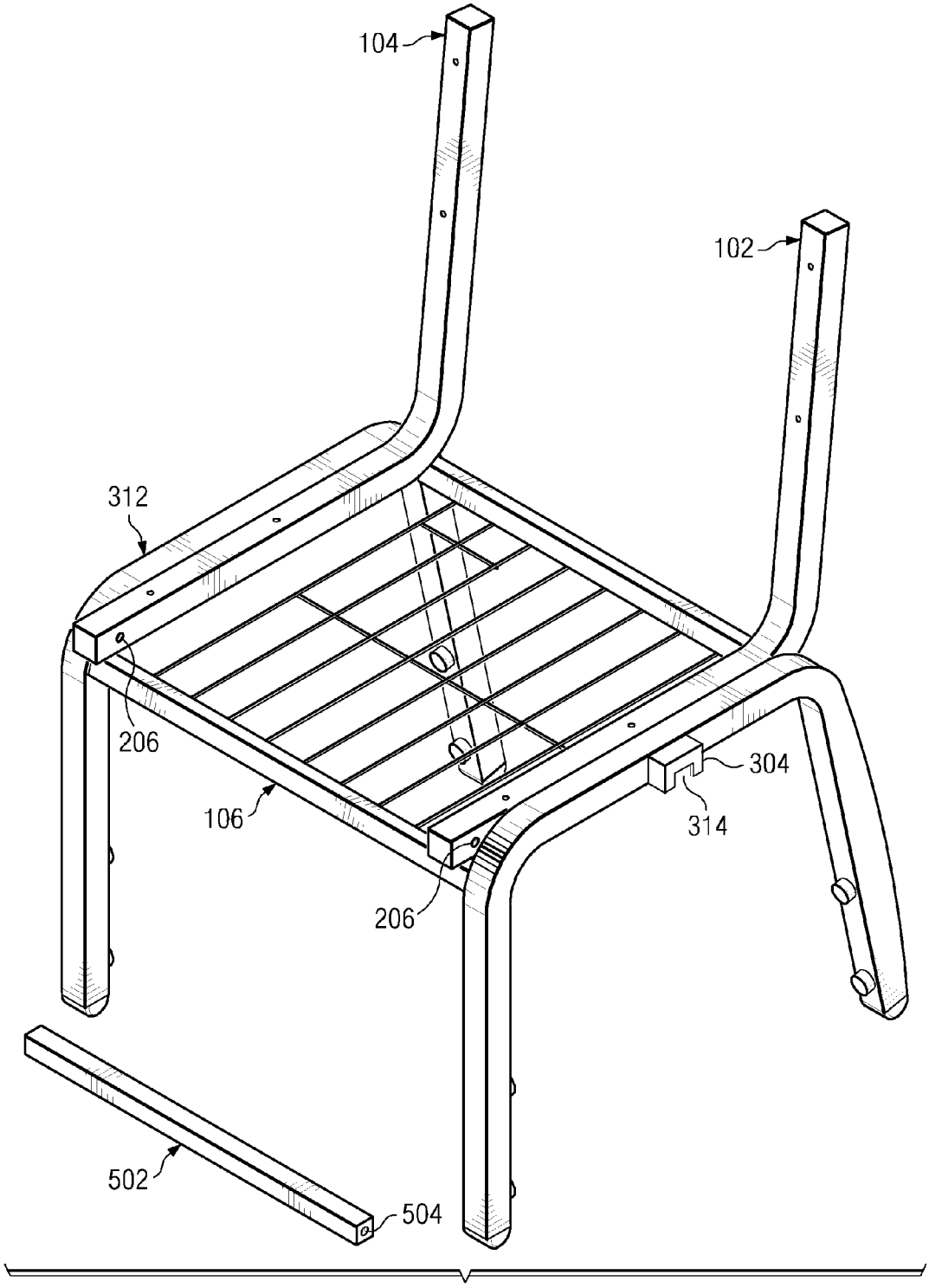
FIG. 5A illustrates an exemplary embodiment of a knock-down chair with an exemplary frame leg support brace.
Figure 5B:
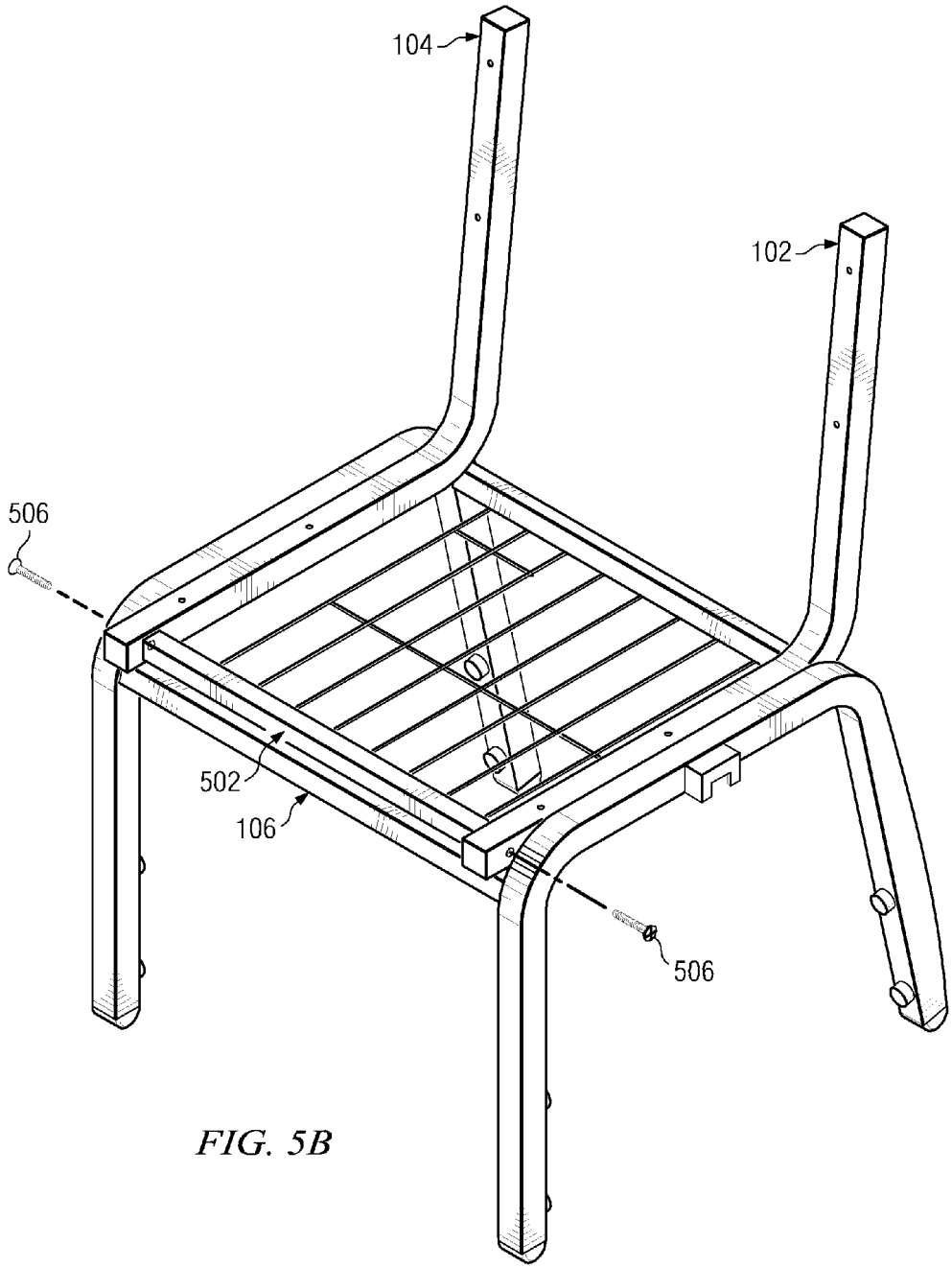
FIG. 5B illustrates an exemplary embodiment of a knock-down chair with an exemplary frame leg support brace attached.

Referring now to FIGS. 5A and 5B, an exemplary embodiment of the knock-down chair 100 is shown along with a frame leg support brace 502 is shown. The cross-member 106 is attached between the right frame member 102 and the left frame member 104 at a planar lower support level below the planar seat layer 312. Also shown is the frame leg support brace 502. The frame leg support brace 502 is a rectangular beam dimensioned to be approximately ¾ inch by ¾ inch and approximately sixteen inches in length. A threaded opening 504 is located on each end of the frame leg support brace 502. The frame leg support brace 502 can additionally be a rectangular or circular tube that is closed at each end. Once attached with bolts 506, as shown in FIG. 5B, the frame leg support brace 502 and the cross-member 106 form a three-point stability system to assist in maintaining the stability of the knock-down chair 100 while an individual is seated upon the knock-down chair 100 and while the knock-down chair 100 is stacked with other knock-down chairs 100.

Figure 6A:
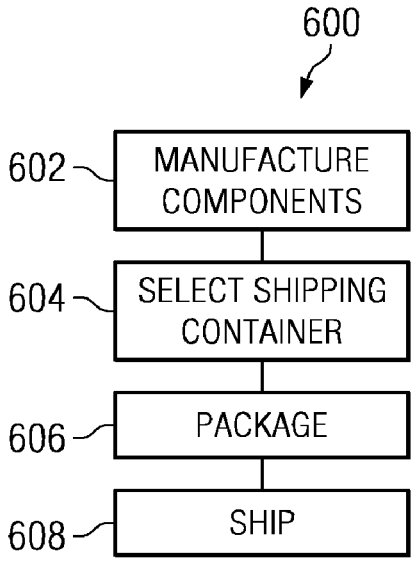
FIG. 6A illustrates an exemplary embodiment of a method of shipping a knock-down chair.
Figure 6B:
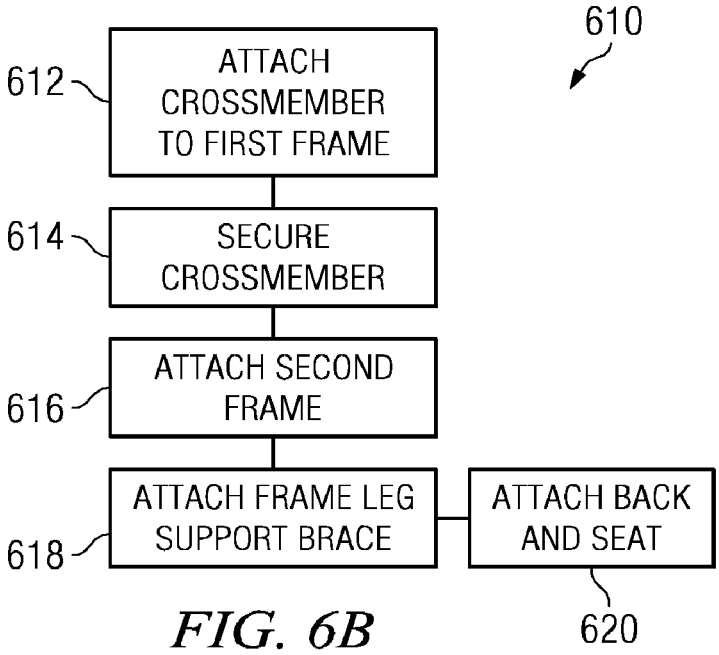
FIG. 6B illustrates an exemplary embodiment of a method of assembling a knock-down chair.

Referring now to FIG. 6, a process 600 for shipping the knock-down chair is illustrated. The knock-down chair 100 can be shipped in four pieces, not including back and seat cushions or fastening hardware (e.g., screws). The four pieces are the right frame member 102, the left frame member 104, the cross-member 106, and the frame leg support brace 502. A manufacturer, in step 602, manufactures the components of the knock-down chair 100 in accordance with the stackable knock-down design described herein. The manufacture selects a shipping container 604 suitable to ship one or more knock-down chairs 100. Since the manufacture is not shipping an assembled chair, the shipping containers can be selected to be as small as 3"×22"×36" for one knockdown chair 100. Skilled artisans will appreciate that this size is exemplary for one embodied size of knock-down chair 100 illustrated herein and that many other sizes can be selected depending on the size of the components and the ultimate size of the knockdown chair 100. The manufacturer places the components for one or more chairs in a shipping container 606. If components for more than one chair are placed in the shipping container, the manufacture may choose to package the components based on component type (i.e. left frame member 102) or package the components based on a complete knock-down chair 100. Thereafter, the manufacture ships the unassembled knock-down chairs 100 to an end user 608.

Upon receipt, a user may remove the four pieces from the box and readily assemble 610 the knock-down chair 100. Assembly of the knock-down chair 100 is accomplished by sliding 612 the rectangular channels 406 of the cross-member 106 over the front and rear male joints 202, 204 of either of the right frame member 102. Skilled artisans can appreciate that attaching to the right frame member 102 first is for illustrative purposes only as one could easily start assembly by attaching to the left frame member 104. Skilled artisans would also readily understand that one could start assembly by attaching the frame leg support brace 502 to a right or left frame member 102, 104 first. After the cross-member 106 is attached to the right frame member 102, the cross-member 106 is secured 614 with screws (not shown) through the treaded channel 302 of the front and rear male joints 202, 204. As described herein, this method of securing may also be accomplished by a number of fastening means including snap tight buttons. Subsequently, the left frame member 104 is attached 616 to the cross-member 106 by inserting the rear and front male joints 202, 204 into the remaining rectangular channels 406 of the cross-member 106 and securing it by the same methods as the cross-member 106 was secured to the right frame member 102. Thereafter, the frame leg support brace 502 is attached 618 to between the right and left frame members 102, 104. The frame leg support brace 502 is placed substantially parallel to and just below the planar seat layer 312. The frame leg support brace 502 is additionally placed such that the threaded openings 504 of the frame leg support brace 502 are align with the frame leg support brace channels 206 of the right and left frame members 102, 104. A bolt 506 is then placed through the frame leg support brace channel 206 into the treaded opening 504. As described herein, other methods of attaching and securing the frame leg support brace to the right and left frame members 102, 104 can be utilized. At this stage, the knock-down chair 100 is assembled, requiring only the attaching 620 of the back and seat cushion (not shown) by placing screws through holes 108 into the back and seat (not shown).

Additionally, skilled artisans would be able to appreciate that a change in material may necessarily require a change in fastening means. As an example, where two components are welded when made of metal, a fastening means for glue, riveting or another fastener may be used for plastic or wood.

Although the preferred embodiment has been described in detail, it should be understood that various changes, substitutions and alterations can be made therein without departing from the spirit and scope of the invention as defined by the appended claims.

It will be appreciated by those skilled in the art having the benefit of this disclosure that this disclosure provides a new auditorium chair structure. The auditorium chair structure has the following components: fastening with screws, snap tight buttons, or other fasteners, dimensioning in accordance with use in current auditorium chair sizes, and fabrication design enabling efficient shipment while maintaining stability and stacking capability. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An auditorium chair, comprising:

a substantially planar seat layer;

a substantially planar lower support layer;

a first frame member said first frame member comprises a front leg, a rear leg, a planar seat layer, a back support, a first male joint disposed on an interior facing side of said front leg and a second male joint disposed on an interior facing side of said back leg;

a second frame member, said second frame member comprises a front leg, a rear leg, a planar seat layer, a back support, a third male joint disposed on an interior facing side of said front leg and a fourth male joint disposed on an interior facing side of said back leg;

a three point stability system, said three point stability system further comprising a first support beam connected by a first fastening means to said first male joint of the first frame member and by a second fastening means to the third male joint of the second frame member at said planar lower support layer, a second support beam connected by a third fastening means to said second male joint of the first frame member and by a fourth fastening means to the fourth male joint of the second frame member at said planar lower support layer, and a frame leg support brace connected by a fifth and sixth fastening means to said first and second frame members at a planar layer above said planar lower support surface and below said planar seat layer;

a seat attached on a first portion to said planar seat layer of said first frame member and on a second portion to said planar seat layer of said second frame member; and a backrest attached on a first portion to said back support of said first frame member and on a second portion to said back support of said second frame member.

2. The chair of claim 1, further comprising a first interlocking interface disposed on said first frame member and a second interlocking interface disposed on said second frame member, wherein said first interlocking interface is adapted to be connected to said second interlocking interface such that a number of chairs of claim 1 are adapted to be interlocked via a connection established between said first interlocking interface and said second interlocking interface.

3. The chair of claim 2, wherein said first interlocking interface and said second interlocking interface establish an interlocking connection via a magnetic coupling.

4. The chair of claim 2, wherein said first interlocking interface is an interlocking receiver joint and said second interlocking interface is an interlocking hook joint.

5. The chair of claim 1 wherein said first and second support beams are connected by a wire mesh extending from a long side of said first beam to a long side of said second support beam and parallel to said first and second frame members.

6. The chair of claim 1 wherein said auditorium chair is made of metal.

7. The chair of claim 1 wherein said auditorium chair is made of a composite material.

8. The chair of claim 1, wherein said auditorium chair is adapted to be assembled by:

connecting said first and second support beams to said first frame member by:

sliding a first recess of said first support beam over the first male joint of said first frame member, sliding a second recess of said second support beam over the second male joint of said first frame member, and securing said first and second support beams to said first frame member by said first and third fastening means;

connecting said first and second support beams to said second frame member by:

sliding a third recess of said first support beam over the third male joint of said second frame member, sliding a fourth recess of said second support beam over the fourth male joint of said second frame member, and securing said first and second support beams to said second frame member by said second and fourth fastening means; and connecting said frame leg support brace between said first and second frame members with the fifth and sixth fastening means.

9. A method of shipping a stackable chair, the method comprising:

providing components to a stackable chair, the stackable chair comprising a knock-down design, the knock-down design configured to enable a shipment of an unassembled stackable chair to a consumer and enable the consumer to readily assemble the stackable chair for use;

packaging at least one set of the components in a compact container, the at least one set of the components comprising the components of the unassembled stackable chair; and shipping the compact container to the consumer;

wherein the knock-down design comprises:

a substantially planar seat layer;

a substantially planar lower support layer;

a first frame member said first frame member comprises a front leg, a rear leg, a planar seat layer, a back support, a first male joint disposed on an interior facing side of said front leg and a second male joint disposed on an interior facing side of said back leg;

a second frame member, said second frame member comprises a front leg, a rear leg, a planar seat layer, a back support, a third male joint disposed on an interior facing side of said front leg and a fourth male joint disposed on an interior facing side of said back leg;

a three point stability system, said three point stability system further comprising a first support beam connected by a first fastening means to said first male joint of the first frame member and by a second fastening means to the third male joint of the second frame member at said planar lower support layer, a second support beam connected by a third fastening means to said second male joint of the first frame member and by a fourth fastening means to the fourth male joint of the second frame member at said planar lower support layer, and a frame leg support brace connected by a fifth and sixth fastening means to said first and second frame members at a planar layer above said planar lower support surface and below said planar seat layer;

a seat attached on a first portion to said planar seat layer of said first frame member and on a second portion to said planar seat layer of said second frame member; and a backrest attached on a first portion to said back support of said first frame member and on a second portion to said back support of said second frame member.

10. The method of claim 9, wherein the knock-down design further comprises a first interlocking interface disposed on the first frame member and a second interlocking interface disposed on the second frame member, wherein the first interlocking interface is adapted to be connected to the second interlocking interface such that a number of stackable chairs of are adapted to be interlocked via a connection established between the first interlocking interface and said second interlocking interface.

11. The method of claim 10, wherein the first interlocking interface and the second interlocking interface establish an interlocking connection via a magnetic coupling.

12. The method of claim 10, wherein the first interlocking interface is an interlocking receiver joint and said second interlocking interface is an interlocking hook joint.

13. The method of claim 9, wherein the first and second support beams are connected by a wire mesh extending from a long side of the first beam to a long side of said second support beam and parallel to the first and second frame members.

14. The method of claim 9, wherein the stackable chair is made of metal.

15. The method of claim 9, wherein the stackable chair is made of a composite material.

16. The method of claim 9, wherein the stackable chair is adapted to be assembled by:

connecting the first and second support beams to the first frame member by sliding a first recess of the first support beam over the first male joint and a second recess of the second support beam over the second male joint of the first frame member;

connecting the first and second support beams to the second frame member by sliding a third recess of the first support beam over the third male joint and a fourth recess of the second support beam over the fourth male joint of the second frame member; and connecting the frame leg support brace between the first and second frame members with a third fastening means.

17. A knock-down chair for use in temporary auditorium seating, said knock-down chair comprising:

a first frame member, said first frame member comprises a front leg, a rear leg, a planar seat layer, a back support, a first male joint disposed on an interior facing side of said front leg and a second male joint disposed on an interior facing side of said back leg;

a second frame member, said second frame member comprises a front leg, a rear leg, a planar seat layer, a back support, a third male joint disposed on an interior facing side of said front leg and a fourth male joint disposed on an interior facing side of said back leg;

a cross-member structure, wherein said cross-member structure is attached at a upper planar support layer by a first fastening means to said first male joint and by a second fastening means to the second male joint of said first frame member, and by a third fastening means to said third male joint and by a fourth fastening means to the fourth male joint of said second frame member;

a cross support brace, said cross support brace secured by a fifth and sixth fastening means between said first frame member and said second frame member at a lower planar support layer;

a seat attached on a first portion to said planar seat layer of said first frame member and on a second portion to said planar seat layer of said second frame member; and a backrest attached on a first portion to said back support of said first frame member and on a second portion to said back support of said second frame member.

* * * * *